United States Patent [19]

McLaren

[11] 4,185,765

[45] Jan. 29, 1980

[54] HERMETIC SEALED CARTON

[75] Inventor: Edwin C. McLaren, Apple Valley, Minn.

[73] Assignee: Champion International Corporation, Stamford, Conn.

[21] Appl. No.: 927,338

[22] Filed: Jul. 24, 1978

[51] Int. Cl.[2] ..... B65D 5/72; B65D 5/02

[52] U.S. Cl. ..... 229/17 G; 229/17 R

[58] Field of Search ..... 229/17 R, 17 G, 37

[56] References Cited

U.S. PATENT DOCUMENTS

| | | | |
|---|---|---|---|
| 2,087,934 | 7/1937 | Anderson | 229/52 B UX |
| 2,300,703 | 11/1942 | Ray | 229/17 G UX |
| 2,321,139 | 6/1943 | Gruger | 229/17 G X |
| 3,172,594 | 3/1965 | Kuchenbecker | 229/17 G |
| 3,203,614 | 8/1965 | Larson et al. | 229/17 G |
| 3,227,353 | 1/1966 | Bump | 229/17 G |
| 3,269,644 | 8/1966 | Bump | 229/17 G X |
| 3,327,920 | 6/1967 | Hynes et al. | 229/17 G |
| 3,797,726 | 3/1974 | Reil | 229/17 R |

*Primary Examiner*—Davis T. Moorhead
*Attorney, Agent, or Firm*—Evelyn M. Sommer

[57] ABSTRACT

A hermetically sealed carton of the type having a generally rectangular cross-section with four side walls, a bottom closure and a top closure including a vertical fin formed by a face-to-face seal of the outer portions of two opposed top closure flaps integrally formed with and hingedly attached to opposed side walls and triangular folds integrally formed with and hingedly attached to the other opposed side walls, with the improvement comprising means joining said fin portions only at the base thereof in a face-to-face relationship and scorelines placed in said fin portions such that when an upward pressure is applied to one of said triangular folds of said top closure, said fin portions separate at said scorelines above said joining means to allow easy access for separating said fin portions.

2 Claims, 7 Drawing Figures

HERMETIC SEALED CARTON

BACKGROUND OF THE INVENTION

The present invention relates to a container or carton of the type which is formed from a blank of thermoplastic-coated paper or cardboard to form a generally rectangular container body which, after the goods intended for packaging have been introduced into the container body, is closed at the top in such a manner that a sealing fin projects from the upper end surface of the carton which not only can be folded to either side to form a carton with a flat top which is convenient for shipping but which also has scorelines or lines of articulation therein so placed that an upward pressure on one end of said fin causes a separation of the fin walls thereby providing container access means for separating said fin portions to obtain access to the contents of the carton.

Modern forms of distribution demand that packing containers or cartons be shaped or be able to assume a shape which is suitable for stacking and collection of the cartons in units adapted for storage and transport. Thus, it is common to use so called roller pallets for the transport and storage of products of different kinds whereby the individual packing cartons for the products concerned are stacked in several layers on one another in the roller pallet. The containers are kept together thereafter in the roller pallet during transport and storage until a consumer chooses the product in question and in doing so separates a number of packing cartons from the roller pallet.

However, for certain types of cartons, such as the so called "gable-top" carton, special stacking sheets, insertions and the like, have to be used in order to be able to use the roller pallet. However, the use of special stacking sheets, insertions and the like, is not only expensive but such items are also difficult and time consuming to handle. Thus, the prior art has attempted to overcome this problem by providing a carton similar to the "gable-top" carton which has a vertical fin extending from the top thereof which has a harder crease line on one side of the base thereof than the other whereby the fin has a tendency to lean to one side such that when it is subjected to a load, for example from another carton being stacked or placed on top of it, the slanted fin is pressed down so that a substantially flat end face is obtained which facilitates stacking and transport. However, with such containers, special weakened areas or tear strips must be arranged so that the user thereof can tear the carton along the weakened line to obtain access to the carton contents.

The present invention is an improvement on the construction taught in the prior art by providing a carton that not only has a vertical fin which can be folded to either side to provide a flat top surface for stacking and skipping, but also has score lines or lines or articulation so positioned in said fin that an upward pressure on one end of said fin causes the fin walls to separate thus providing container access means for easy access to the contents of the carton.

SUMMARY OF THE INVENTION

The present invention overcomes the problem of the prior art and provides cartons which have a flat upper surface for storage and transport and yet provide an easy access to the contents of the container without the use of weakening or tear lines.

Briefly stated, the invention relates to a hermetically sealed carton of the type having a generally rectangular cross-section with opposing side walls and end walls, a bottom closure and a top closure including a vertical fin formed by a face-to-face joinder of the outer portions of two opposed top closure flaps integrally formed with and hingedly extended from opposed side walls and triangular panels forming two closure flaps integrally formed with and hingedly extended from the opposed end walls and, as an improvement, comprises means joining said walls forming the fin only at the base thereof in a face-to-face relationship whereby said fin may be folded flat on either side thereof and score lines positioned in said fin walls such that when upward pressure is applied to said triangular panel of said top closure adjacent said score lines, said fin walls separate at said score lines above said joining means to allow easy access for separating said fin walls.

It is important that the vertical fin portions are sealed in a face-to-face relationship only at the base thereof so that the upward pressure applied to the triangular panels of the top closure allow the fin walls to separate above the location at which the seal is placed. Thus, the invention also relates to a method of forming a hermetically sealed carton of the type having a general rectangular cross-section with four side walls, a bottom closure and a top closure including a double walled vertical fin formed by a face-to-face joinder of the outer portions of two opposed top closure flaps integrally formed with and hingedly extending from opposed side walls and the triangular panels forming two closure flaps integrally formed with and hingedly extending from the other opposed side walls, the improvement comprising the steps of forming lines of articulation in said vertical fin walls converging toward the base of said fin walls such that when an upward pressure is applied to said triangular panel of said top closure adjacent said lines of articulation, said fin walls separate at said articulation lines to allow easy access for separating said fin walls after joinder thereof, and sealing said fin walls only at the base thereof in said face-to-face relationship whereby said fin walls separate above said sealed base.

The invention further relates to a carton blank for forming a hermetically sealed carton having a top closure including a fin with an easy opening access, said fin being capable of lying horizontally for shipping and stacking, and vertically for opening, said blank comprising first, second, third and fourth side wall panels integrally formed with and hingedly connected to each other such that the blank can be converted to a rectangular container body, bottom closure panels for closing the bottom of said container body, first and second triangular panels integrally formed with and hingedly connected to the top of opposing side wall panels, first and second rectangular panels integrally formed and hingedly connected to the top of the remaining opposing side wall panels, first, second and third triangular webs integrally formed with and hingedly attached to the sides of each pair of adjacent ones of said triangular panels and said rectangular panels, and a fourth triangular web integrally formed with and hingedly attached to the remaining edge of one of said triangular panels, an extended panel integrally formed with and hingedly attached to the top edge of each of said first and second rectangular panels and the top edge of each of said triangular webs whereby when said container body is formed, and said rectangular panels are folded inwardly, each of said first and second triangular panels extend horizontally away from its corresponding side wall and each of said triangular webs is folded over and abuts the upper side of a corresponding triangular panel to form double walled triangular projections, said extended panel forming a double walled fin rising vertically from and across the top of said container, and extending beyond the side walls thereof and converging score lines extending from the top of said extended panel to the base thereof such that when said blank is formed into a container body and said fin extends vertically from and across the top of said carton and extending beyond the side walls thereof, an upward pressure on a predetermined one of said triangular panels causes the walls of said fin to separate at said score lines, thus providing easy access for separating said fin walls.

BRIEF DESCRIPTION OF THE DRAWINGS

These and other objects and advantages of the present invention will be disclosed in the course of the following specification, reference being had to the ccompanying drawings in which.

DESCRIPTION OF THE PREFERRED EMBODIMENT

Figure 1:
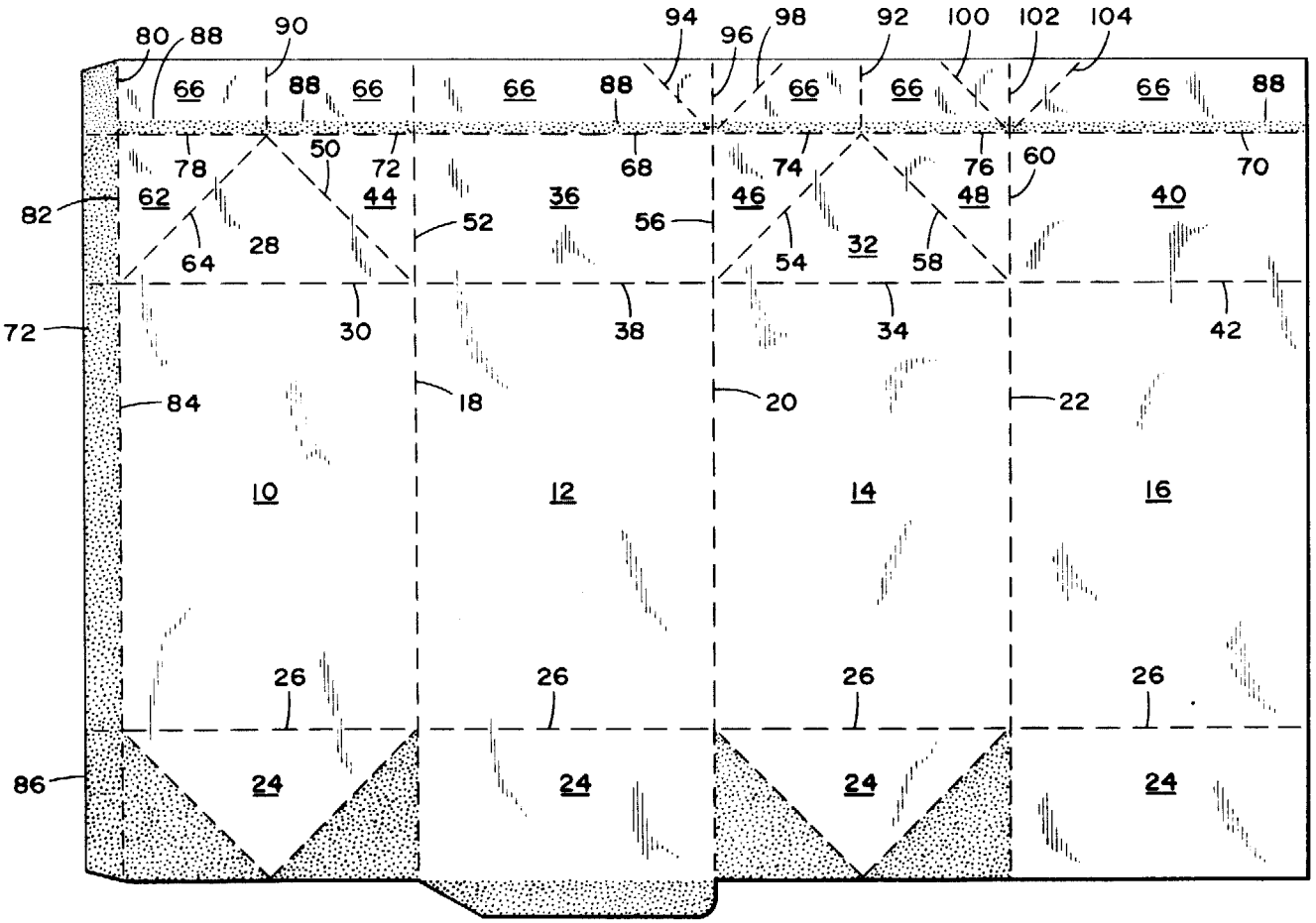
FIG. 1 is a plan view of a carton blank incorporating score lines which enable the blank to be formed into a carton of substantially rectangular cross section which has a double wall fin extending vertically from the top thereof that can be folded to either side to form a flat top carton and which has score lines in the fin such that when upward pressure is applied to one end of said fin, the fin walls separate at said score lines to allow easy access for separating the remainder of said fin walls.

The cartons of the present invention are manufactured from a blank such as that shown in FIG. 1. The blank has first side wall panel 10 second side wall panel 12, third side wall panel 14 and fourth side wall panel 16 each integrally formed with and hingedly connected to each other along lines of articulation 18, 20 and 22 respectively. Bottom closure panels 24 are integrally formed with and hingedly attached to the side wall panels along lines of articulation 26 and are folded along the score lines shown and glued in a well-known manner to close the bottom of said carton. A first triangular panel 28 is integrally formed with and hingedly attached to the top of first side wall panel 10 along score line or line of articulation 30. A second triangular panel 32 is integrally formed with and hingedly attached to third side wall panel 14 along score line 34. In like manner, a first rectangular panel 36 is integrally formed with and hingedly attached to second side wall panel 12 along score line 38 and second rectangular panel 40 is integrally formed with and hingedly attached to fourth side wall panel 16 along score line 42. First, second and third triangular webs 44, 46 and 48 are integrally formed with and hingedly attached to the sides of each pair of adjacent ones of said triangular panels 28 and 32 and rectangular panels 36 and 40. Thus, first triangular web 44 is integrally formed with and hingedly attached to first triangular panel 28 along score line 50 and is also integrally formed with and hingedly attached to first rectangular panel 36 along score line 52. In like manner, second triangular web 46 is integrally formed with and hingedly attached to second triangular panel 32 along score line 54 and is also integrally formed with and hingedly attached to first rectangular panel 36 along score line 56. Third triangular web 48 is integrally formed with and hingedly attached to second triangular panel 32 along score line 58 and is also integrally formed with and hingedly attached to second rectangular panel 40 along score line 60. A fourth triangular web 62 is integrally formed with and hingedly attached to the remaining edge of first triangular panel 28 along score line 64. An extended panel 66 is integrally formed with and hingedly attached to the top edge 68 and 70 of said first and second rectangular panels 36 and 40 respectively and to the top edge of said triangular webs 44, 46, 48 and 62 along score lines 72, 74, 76 and 78 respectively. A glue panel 72 is integrally formed with and hingedly attached to one end of extended panel 66 along line of articulation 80, the remaining side of fourth triangular web 62 along score line 82, the remaining side of first side wall panel 10 along score line 84 and one side of bottom closure panel 24 along score line 86. The shaded areas on the bottom closure panels 24, the glue strip 72, and extended panel 66 indicate the areas to which the glue is applied during the folding and forming operations in which the blank is formed into a carton. It will be noted that the glue strip 88 is located directly at the base of extended panel 66. This particular location of glue strip 88 is important as will be seen hereinafter. When the blank shown in FIG. 1 is folded to form a carton, extended panel 66 forms a vertical fin across the top and extending beyond the sides of the carton, and is formed of two walls, the first of which extends from score line 90 to score line 92 going to the right in FIG. 1 and the second of which goes from score line 90 to score line 92 by going to the left. At this point, the carton is folded and glue panel 72 is attached to the right edge of fourth side wall panel 16, second rectangular panel 40, extended panel 66 and bottom closure panel 24. Since the width of the carton is determined by the width of second and fourth side wall panels 12 and 16 respectively, it will be seen that a vertical fin is formed from extended panel 66 which projects outwardly from the top and extends beyond each side of the carton a distance equal to the length of score lines 72 and 78 or 74 and 76. Further, in the folded condition, first rectangular panel 36 and second rectangular panel 40 are folded inwardly and, since their width is one half the width of the carton, their edges 68 and 70 meet at the center of the carton and both panels 36 and 40 are flat in the plane of score lines 38 and 42, the upper edges of the carton walls. In like manner, triangular panels 28 and 32 are flat in the plane of score lines 30 and 34, the other upper edges of the carton side walls, with first triangular web 44 and fourth triangular web 62 folded about score lines 50 and 64 to rest on top of first triangular panel 28 and second triangular web 46 and third triangular web 48 fold inwardly about score lines 54 and 58 to rest on top of second triangular panel 32. This is the condition of the carton represented by FIG. 4 and will be discussed in detail hereinafter with reference thereto. Also, score lines 94, 96, 98, 100, 102 and 104 in extended panel 66 are provided to allow a separation point between the walls of the vertical fin to provide container access means for separating the fin walls as will be described hereinafter with reference to FIG. 6.

Figure 3:
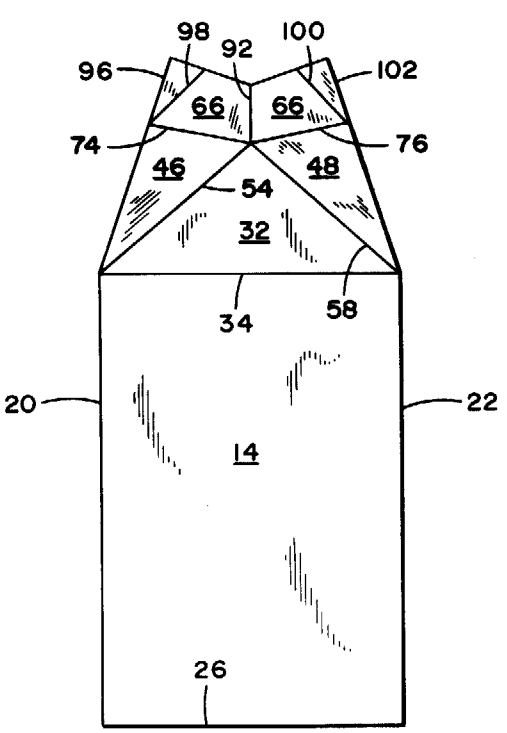
FIG. 3 is an end view of the carton in its partially folded condition illustrated in FIG. 2.
Figure 2:
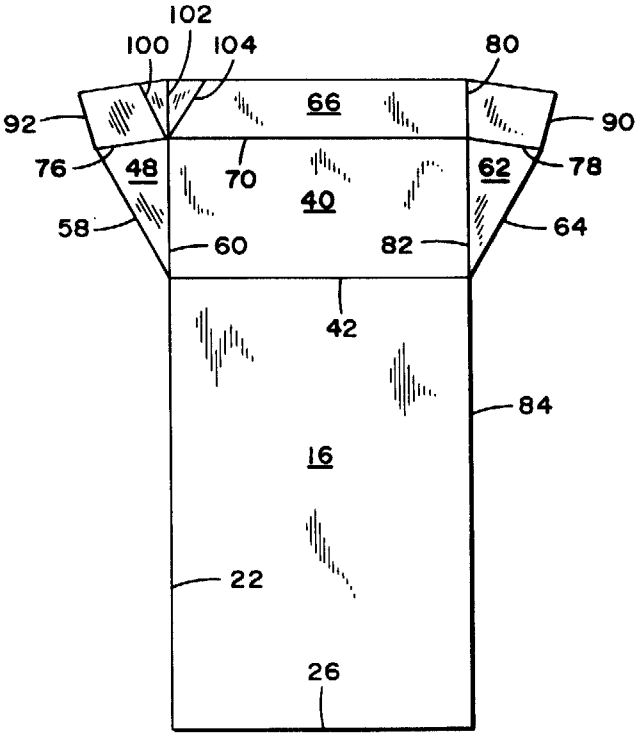
FIG. 2 is a side view of the carton in its partially folded condition.

FIG. 2 is a side view of the partially formed carton constructed from the blank of FIG. 1. In FIG. 2, second side wall panel 16 has attached to the top thereof second rectangular panel 40 along score line 42 and, as shown in FIG. 3, second rectangular panel 40 is folded about score line 42 slightly into the plane of the paper. On the left side of panel 40 can be seen third triangular web 48 and on the right side of panel 40 can be seen fourth triangular web 62. Extended panel 66, as can be seen, projects from score line 90 to score line 92 and includes a central section and two end sections, and, as is evident, represents only one half of a vertical fin, the other side of which is congruent to that shown. Third triangular web 48 and its associated extended panel 66 bend slightly into the plane of the paper about score lines 58, 60 and 76 thus forming a V-shaped spout with the center of the V along score line 92. In like manner, fourth triangular web 62 and its associated extended panel 66 are folded slightly into the plane of the paper about score lines 64, 78, and 82 thus causing a V-shaped spout with the V formed about score line 90. Crease line pairs 94 and 98 and 100 and 104 extend upwardly in said respective fin walls in a divergent relationship away from the base of the respective intersections 96 and 102 of one of said end sections and said center sections.

FIG. 3 is an end view of the partially folded carton shown in FIG. 2. As can be seen, third side wall panel 14 has attached at the top thereof, second triangular panel 32. Second and third triangular webs 46 and 48 hingedly couple second triangular panel 32 to extended panel 66 with score lines 54, 58, 74 and 76. Score lines 98 and 100 in the extended panel 66 can also be seen. They extend upwardly in each of said fin walls in a divergent relationship away from the base of the intersections 96 and 102 respectively of the center section and end section of said fin walls. Only edge 56 of first rectangular panel 36 can be seen and edge 60 of second rectangular panel 40 can be seen; however, it is obvious that these rectangular panels slope slightly towards the center of the carton.

Figure 4:
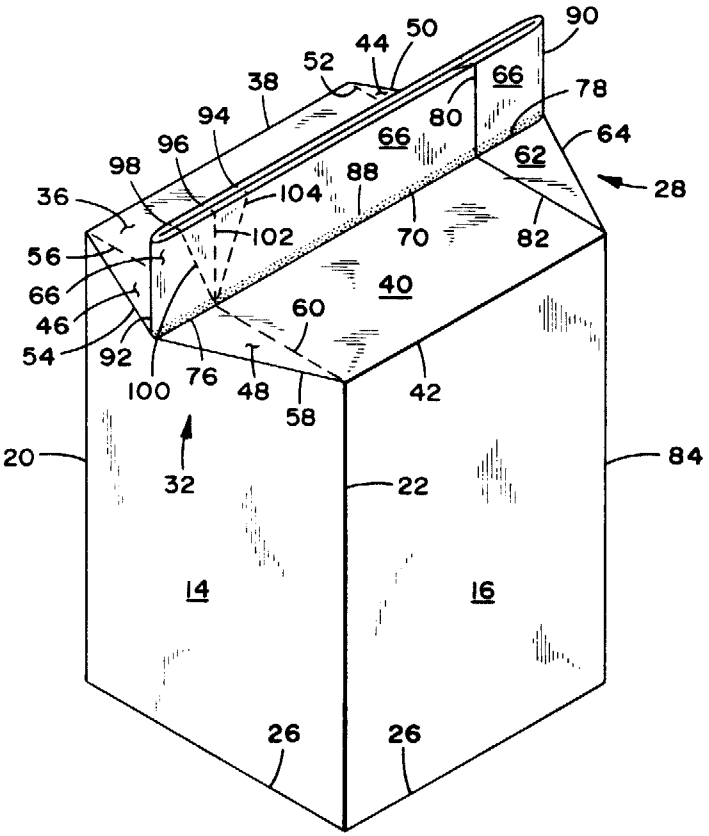
FIG. 4 is a perspective view of the folded carton with the top closure fin in its vertically extended position illustrating the novel score lines near one end thereof which enable the wall portions of said fin to separate when an upward pressure is applied to the end of said fin.

FIG. 4 is a perspective view of the partially folded carton illustrating how the extended panel 66 forms a double wall vertical fin extending across and beyond the edges of the top thereof. In this particular view, first and second rectangular panels 36 and 40 form a flat top cover for the carton and first and second triangular panels 28 and 32 extend horizontally outwardly from each end of the carton with first and fourth triangular webs 44 and 62 overlapping and abutting first triangular panel 28 and second and third triangular webs 46 and 48 overlapping and abutting second triangular panel 32. Extended panel 66 is folded about score lines 78, 72, 68, 74, 76 and 70 to extend vertically from the top of the carton. Inasmuch as the carton is folded and glued along edges 80, 82 and 84, the vertical fin is composed of a double wall with score line 90 at one end thereof and score line 92 at the other.

Figure 5:
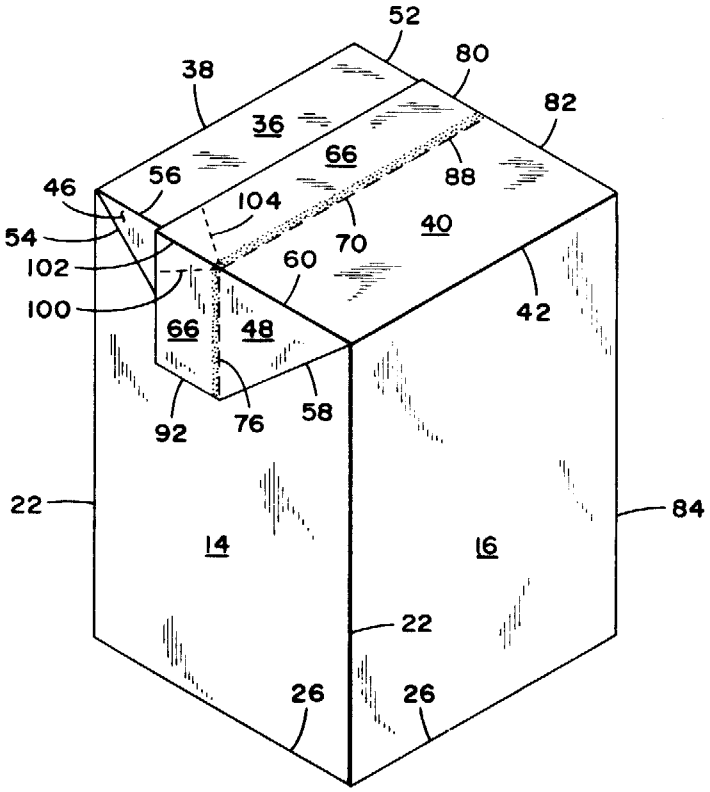
FIG. 5 is a perspective view of the carton in its completed state with the vertical fin shown flattened to one side and extending across the top and down each side of the carton for purposes of shipment and storage.

FIG. 5 is a perspective view of the carton in its completely folded condition wherein the top of the carton is flat and thus convenient for stacking, storage and shipping. In order to construct the carton in FIG. 5 from the carton in FIG. 4, extended panel 66 is simply folded to the left in FIG. 4 about score lines 76, 70 and 78 and then the triangular end portions are folded down about score lines 56, 60, 102, 52, 80 and 82. The triangular end portions are then tacked or otherwise glued to the side wall panels 14 and 10.

Figure 6:
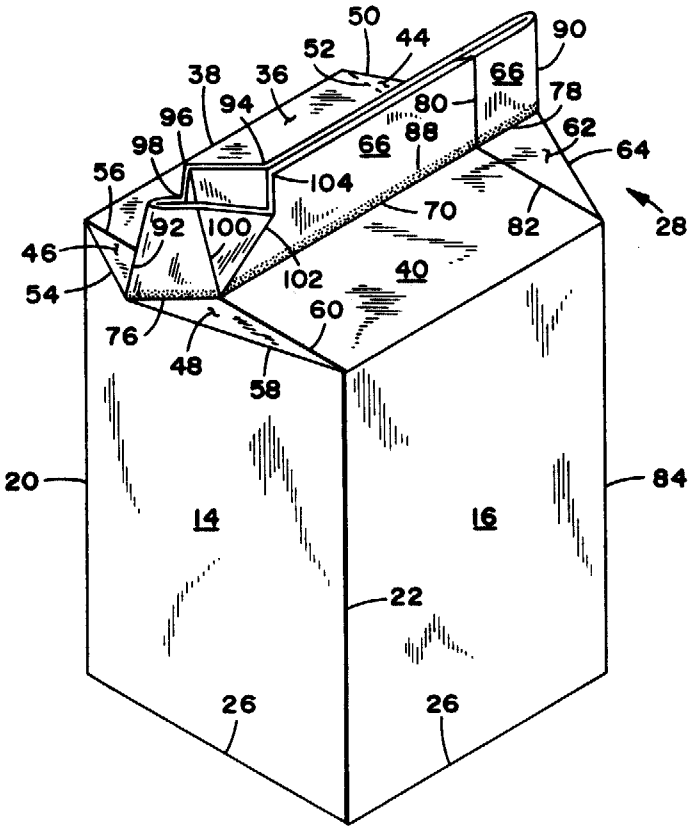
FIG. 6 is a perspective view of the carton in its completed state with the top fin in its vertically extended position and a predetermined end of the fin moved in an upward direction and illustrating the resulting separation of the fin portions along the lines of articulation which allow easy access to separate the remaining portions of the fin.

When it is desired to use the contents of the package, the triangular end portions are pulled loose from the sides 10 and 14 and extended panel 66 restored to its vertical position to form the double wall vertical fin shown in FIG. 4 and FIG. 6. It will be recalled when the carton is first formed, the base of the vertical fin is glued together along glue line 88. The contents of the container are kept intact by virtue of that glue line. If an upward force is now applied to second triangular panel 32 which is overlapped and abutted by triangular segments 46 and 48, the resulting movement causes the end section and center section forming part of the vertical fin to buckle at their intersections formed by score lines 96 and 102 thus separating the two walls as can be seen in FIG. 6. By now grasping the two separated walls, the consumer can tear the two walls apart where they are joined by glue strip 88 thus opening the carton to use the contents thereof. As stated earlier, it is critical that glue strip 88 be applied at the base of the vertical fin formed by extension panel 66 thus gluing together the two walls which form the fin. It can be seen in FIG. 6 that if glue strip 88 were placed higher upon the fin, the walls would not separate along score lines 94, 96, 98, 100, 102 and 104 when an upward pressure is applied to one end of the vertical wall wherein score line 92 is located.

Figure 7:
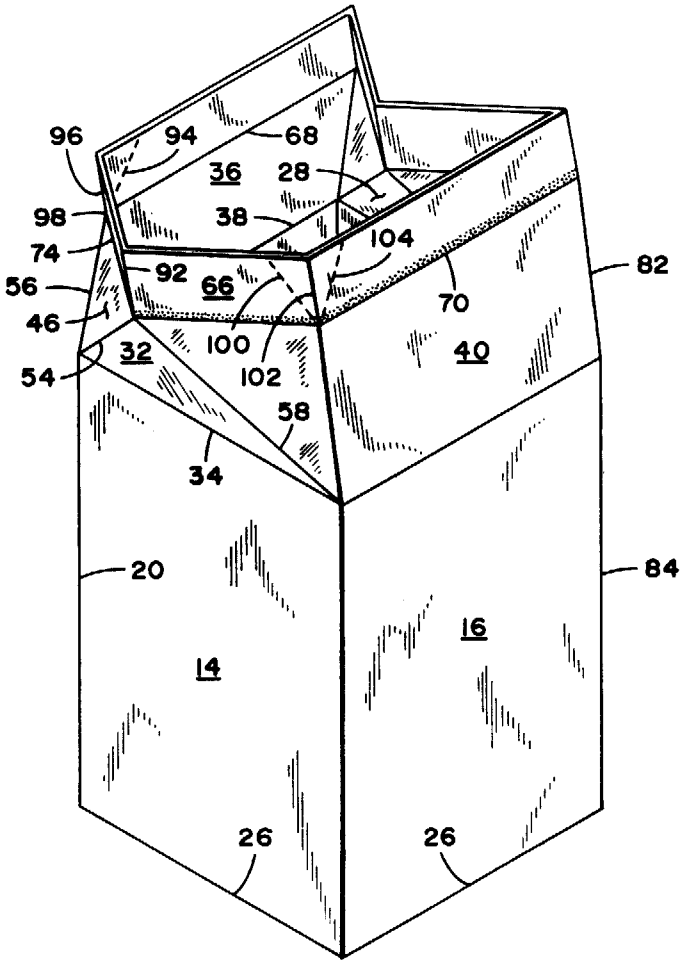
FIG. 7 is a perspective view of the novel carton in its fully opened condition ready to dispense the contents thereof.

FIG. 7 is a perspective view of the carton of the instant invention and its opened state ready to dispense the contents thereof. In this figure, it can be seen that second and third triangular webs 46 and 48 along with extended panel 66 on either side of score line 92 and second triangular panel 32 form a pouring spout to dispense the contents of the carton. When a sufficient amount of the contents have been removed from the carton, it can be refolded to the state shown in FIG. 4.

It is obvious that the appropriate score lines could be located at the other end so that either or both ends could have the easy access capability as shown in FIG. 6.

Thus, there has been disclosed a novel improvement over cartons of the prior art which have a flat top for storage and shipping purposes and yet has an easy access to the carton by means of a double wall fin which can be raised from a horizontal position with the walls of the fin having score lines therein which buckle under pressure to provide an easy access opening and which also has a glue line at the base of the double wall fin so that the two walls can separate at the score lines to form the container access means.

While the invention has been described in connection with a preferred embodiment, it is not intended to limit the scope of the invention to the particular form set forth, but, on the contrary it is intended to cover such alternatives, modifications, and equivalents as may be included within the spirit and scope of the invention as defined by the appended claims.

What is claimed is:

1. In a carton of the type having a generally rectangular cross-section with four side walls, a bottom closure and a top closure including a double walled fin formed by a face-to-face joinder of the outer portions of two opposed top closure flaps extending from opposed side walls and triangular panels forming two closure flaps extending from the other opposed walls, the improvement comprising:

a. means joining said walls forming the fin only at the base thereof in a face-to-face relationship whereby said fin may be folded flat on either side thereof, and b. opposed angled score lines positioned in said fin walls beginning at a common point adjacent said base of said fin and diverging therefrom to terminate at the upper edge of said fin, each said fin further including an additional score line bisecting said opposed angled score lines such that when upward pressure is applied to said triangular panel of said top closure adjacent said score lines, said fin walls partially separate at said score lines above said joining means to allow easy access for fully separating said fin walls.

2. A blank for forming a hermetically sealed carton having a top closure including a fin with an easy opening access, said fin being capable of lying horizontally for shipping and stacking and vertically for opening, said blank comprising:

a. first, second, third and fourth sidewall panels integrally formed with and hingedly connected to each other such that the blank can be converted to a rectangular container body, b. bottom closure panels for closing the bottom of said container body, c. first and second triangular panels integrally formed with and hingedly connected to the top of opposing sidewall panels, d. first and second rectangular panels integrally formed with and hingedly connected to the tops of the remaining opposing sidewall panels, e. first, second and third triangular webs integrally formed with and hingedly attached to the sides of each pair of adjacent ones of said triangular panels and said rectangular panels and a fourth triangular web integrally formed with and hingedly attached to the remaining edge of one of said triangular panels, f. an extended panel integrally formed with and hingedly attached to the top edge of each of said first and second rectangular panels and the top edge of each of said triangular webs whereby when said container body is formed and said rectangular panels are folded inwardly, each of said first and second triangular panels extend horizontally away from its corresponding sidewall and each of said triangular webs is folded over and abuts the upper side of a corresponding triangular panel to form double walled triangular projections, said extended panel forming a double walled fin rising vertically from and across the top of said container and extending beyond the side walls thereof, and g. converging score lines extending from the top of said extended panel to the base thereof such that when said blank is formed into a container body and said fin extends vertically from and across the top of said carton and beyond the side walls thereof, an upward pressure on a predetermined one of said triangular panels causes the walls of said fin to partially separate at said score lines, thus providing easy access for fully separating said fin walls.

* * * * *